United States Patent [19]

Schacht

[11] 4,322,173

[45] Mar. 30, 1982

[54] HALF-SPACING FEED MECHANISM FOR MARKING MACHINE

[76] Inventor: Roy A. Schacht, 744 Des Peres Rd., St. Louis, Mo. 63131

[21] Appl. No.: 77,007

[22] Filed: Sep. 19, 1979

Related U.S. Application Data

[62] Division of Ser. No. 959,785, Nov. 13, 1978, Pat. No. 4,229,111.

[51] Int. Cl.[3] ..... B41J 19/58

[52] U.S. Cl. ..... 400/303; 400/134; 400/307; 400/307.2

[58] Field of Search ..... 400/9, 23, 45, 127, 400/130, 131, 134, 134.1, 134.2, 134.3, 134.6, 293, 303, 307, 307.2; 73/471; 251/203

[56] References Cited

U.S. PATENT DOCUMENTS

| | | | |
|---|---|---|---|
| 698,966 | 4/1902 | Kitsee | 400/127 |
| 865,214 | 9/1907 | Schuler | 400/307 |
| 2,065,629 | 12/1936 | Thompson | 400/307 |
| 2,236,352 | 3/1941 | McCarty | 251/203 X |
| 2,263,789 | 11/1941 | Van Degrift | 73/471 X |
| 2,582,372 | 1/1952 | Clarkson | 400/303 X |
| 2,664,985 | 1/1954 | Schacht | 400/131 X |
| 2,664,986 | 1/1954 | Higonnet et al. | 400/9 |
| 2,999,577 | 9/1961 | Colyer et al. | 400/134.3 |
| 3,236,352 | 2/1966 | Schacht | 400/134.2 |
| 3,263,789 | 8/1966 | Schacht | 400/134.2 X |
| 3,785,470 | 1/1974 | Schacht | 400/130 X |
| 3,842,957 | 10/1974 | Wilkin et al. | 400/134 X |
| 3,893,561 | 7/1975 | Gibbons et al. | 400/303 X |

OTHER PUBLICATIONS

IBM Technical Disclosure Bulletin, "Half-Space Device for Standard Typewriter", Lennon, vol. 8, No. 1 Jun. 1965, p. 158.

*Primary Examiner*—Ernest T. Wright, Jr.
*Attorney, Agent, or Firm*—Glenn K. Robbins

[57] ABSTRACT

A marking machine for marking metal nameplates, tags or the like. The marking machine employs a work table supported on a carriage which is moveable into contact with a marking wheel to perform a printing operation. Improved advancing means are provided for the work table utilizing a feed pawl link having a pair of pivot points. One pivot point is connected to a feed link while the second pivot point is connected to a drag link moveable between upper and lower stops in a carriage casting. A bottom pivot point of the drag link is provided with a friction clutch on a pivot connected otherwise to a stationery portion of the machine. An improved feed rack is further provided which is polygonal in cross-section and may have different spaced teeth on each side for selective spacing. Half-spacing adjustment means are provided whereby the feed rack may be moved axially a half-space to change the spacing on the work table. An improved carriage release is further provided which comprises a control member pivoted on the same pivot as the pivotable feed link and engageable with the feed link to cause the feed pawl to move both of its teeth out of engagement with the feed rack to provide for manual movement of the work table as desired.

3 Claims, 22 Drawing Figures

HALF-SPACING FEED MECHANISM FOR MARKING MACHINE

RELATED APPLICATION

This application is a division of applicant's copending parent application Ser. No. 959,785, filed Nov. 13, 1978, granted as U.S. Pat. No. 4,229,111 on Oct. 21, 1980.

SUMMARY OF THE INVENTION

In the past various types of marking machines have been devised for physically imprinting on metal or plastic work pieces such as nameplates, tags or the like. Such marking machines have been shown by my U.S. Pat. Nos. 3,785,470; 3,263,789; 3,236,352 and 2,664,985. Marking machines utilizing rotary imprinting wheels in which the characters appear on the periphery of the wheel and are caused to print against a work piece raised into printing relationship by a vertically reciprocal work table are shown in my U.S. Pat. Nos. 2,664,985 and 3,785,470. The continuously rotating marking or printing wheel is stopped in the printing operation by the engagement of an electromagnetically operated pawl aganst a ratchet wheel keyed to the shaft of the printing wheel.

By means of this invention there has been provided an improved actuating means for moving the work table or advancing it in relation to the supporting carriage and marking wheel to provide for spacing after the marking operations. The improvement provides an actuating means using a pivotable pawl having a pair of teeth which engage corresponding teeth on a feed rack or feed bar. Actuating means comprise a pawl link pivotally connected to one end of the feed pawl and a drag link pivotally connected to another end of the feed pawl. In order to accommodate raising and lowering of the work table during operation of the marking machine a guide slot is provided to limit the pivotal movement connection of the feed pawl with the drag link to an upper and lower position. The drag link is further provided with a friction clutch connection to a stationary portion of the machine to accommodate the raising and lowering of the work table and also to accommodate different thicknesses of work pieces whether they be a nameplate, tag or the like of metal, plastic and other materials of construction. The feed advancing mechanism for the work table not only ensures proper movement of the work table for each operation but also accommodates the raising and lowering of the work table and the use of work pieces such as nameplates and tags of slightly varying thickness.

The marking machine of this invention is further provided with means for half-spacing the work table in relation to the normal spacing between the teeth of the feed rack. This is accomplished by the use of adjusting means whereby the feed rack can be moved axially with respect to the work table one-half tooth space. Further means are provided by the use of the polygonal shaped feed rack whereby spacing of the marking characters can be varied by the use of teeth on the different sides having a different spacing. Each side may be provided with adjustment means for the half-tooth spacing so that half-tooth spacing may be selected regardless of the normal spacing selected.

The marking machine of this invention is further provided with an efficient and simplified carriage release mechanism. This carriage release mechanism is pivoted on the same pivot as the feed pawl link and is provided with a contact means normally out of operation with the feed pawl link which is designed to operate and move the feed pawl link to disengage both teeth of the feed pawl from the feed rack. The work table after disengagement of both teeth of the feed pawl may then be moved manually to any desired position.

The feed pawl advancing mechanism and half-tooth spacing and carriage release are all designed for simple operation of the marking machine with the raising and lowering of the work table. The machine is rugged in operation and can be simply operated and maintained by relatively unskilled workmen.

The above features are objects of this invention and further objects will appear in the detailed description which follows and will be otherwise apparent to those skilled in the art.

For the purpose of illustration of this invention there is shown in the accompanying drawing a preferred embodiment thereof. It is to be understood that the drawing is for the purpose of example only and that the invention is not limited thereto.

IN THE DRAWING

DESCRIPTION OF THE INVENTION

Figure 2:
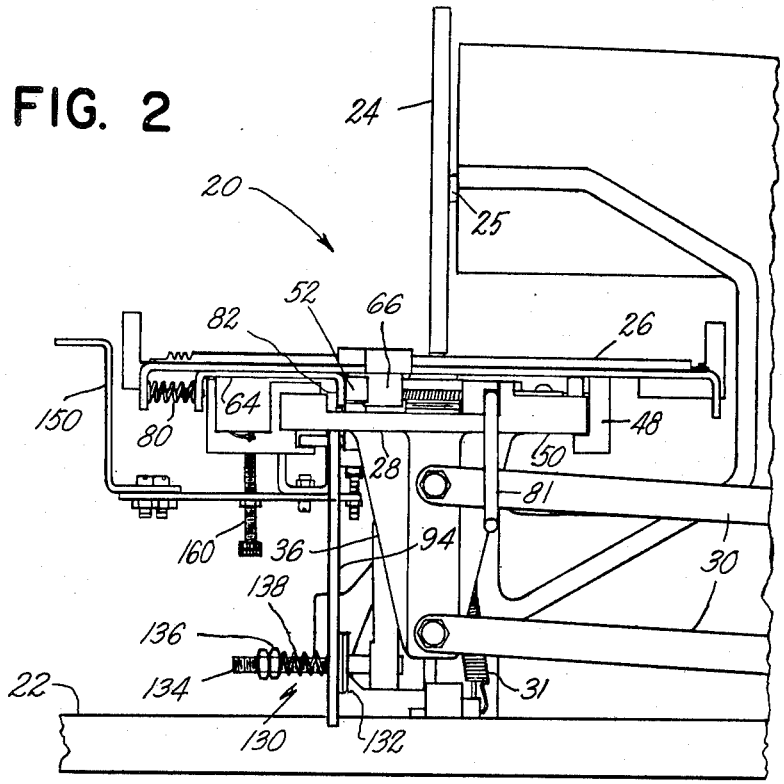
FIG. 2, is a view in side elevation taken from the right side.
Figure 1:
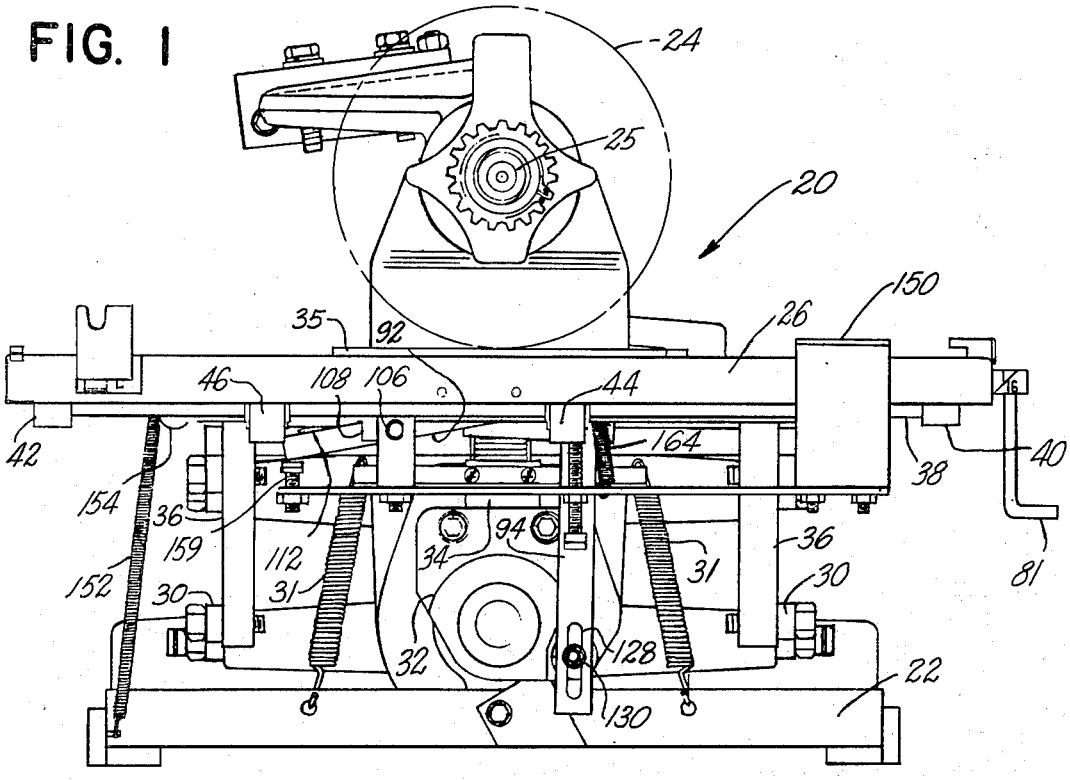
FIG. 1, is a view in front elevation of the machine.
Figure 3:
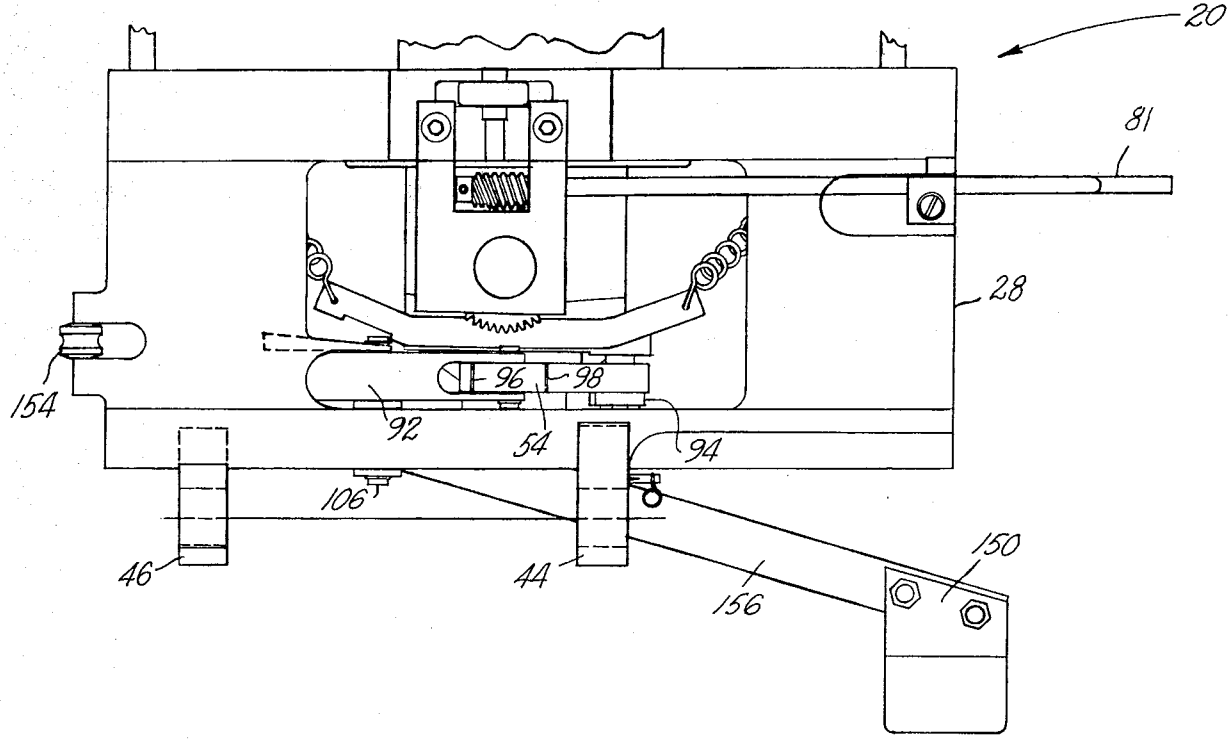
FIG. 3, is a top plan view.

The marking machine of this invention is generally indicated by the reference numeral 20 in FIGS. 1, 2 and 3. It is comprised of a base 22, a motor not shown, a printing or marking wheel 24, a work table 26 and a key-board, not shown, for operation of the machine 20.

The printing wheel 24, as well as the work table 26 and key-board are the same general construction as described in my U.S. Pat. Nos. 2,664,985 and 3,785,470. Thus the printing wheel 24 has printing characters on its periphery and is driven by a shaft 25 connected to a ratchet wheel and to the motor through a friction clutch and is driven by a pulley belt. A magnetically operated pawl is adapted to engage the teeth of a ratchet wheel and stop the printing wheel 24 against the force of the friction clutch.

The work table 26 is supported upon a carriage casting 28 and is pivotally supported on the machine 20 by a yoke 36 and pivot bar connection 30. The carriage casting 28 is raised and lowered against the biasing action of springs 31 by the revolution of a rotary cam 32 which contacts a thrust bar 34 at the bottom of the carriage casting 28 which supports the table 26. The cam 32 is connected to a camshaft which is driven only one revolution in a single marking operation by means of a clutch connected to the motor and which is actuated by a clutch actuator. Appropriate circuitry is provided between the key-board and the various components to effect the operation of the marking wheel 24 and the camshaft as fully described in my afore-mentioned patents. The aforementioned components are fully described therein and form no part of the instant invention, per se and are not deemed necessary to be shown in the drawing except as indicated.

The work table 26 is supported upon a carriage casting 28 as best shown in FIGS. 1, 2 and 3. The carriage casting 28 is more particularly shown in FIGS. 17 through 20. The general relationship of the carriage casting 28 and the work table 26 is similar to that shown in my afore-mentioned U.S. Patents. Thus the carriage casting 28 is moved up and down responsive to movement of the rotary cam 32 and makes a single revolution in a marking operation. The work table 26 which is supported upon the carriage casting 28 and moves with it, is also disengaged for transverse movement so as to advance a work tag 35 or the like which is held upon it for further marking operations. A support of the carriage casting 28 for the vertical movement is provided by a pair of yoke members 36 which are pivotally connected to the pivot bar members 30.

The transverse movement of the work table 26 which is provided by the feed pawl and rack mechanism of this invention, to be fully described herein below, is generally accomplished by sliding movement upon a guide rod 38 which is supported beneath the work table 26 by bearing blocks 40 and 42. The guide rod 38 is journalled upon the carriage casting 28 by journals 44 and 46. Each of the journals 44 and 46 contains a linear ball bearing member 47 to minimize friction between the guide rod 38 and the journals 44 and 46 and facilitate with a minimum of friction transverse movement of the work table 26 with respect to the carriage casting 28. Underneath the rear portion of the work table 26 are hold-down blocks 48 which are L-shaped in configuration and bear underneath a rear portion 50 of the carriage casting 28 for relative sliding movement between the two.

Figure 10:
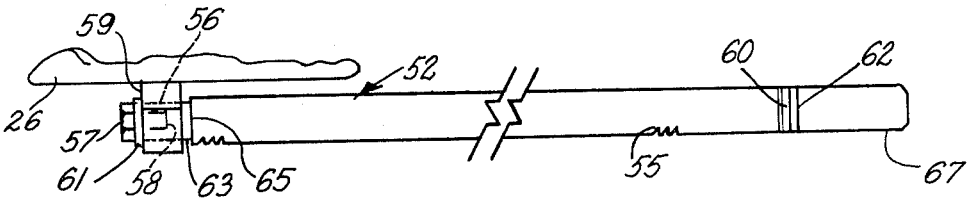
FIG. 10, is a view in front elevation of the feed rack.

In order to provide for advancement of the work table 26 in the transverse movement and spacing for each marking operation the feed rack and pawl mechanism is utilized. A feed rack or feed bar 52 is supported underneath the work table 26 and is used in conjunction with a feed pawl 54. The feed rack 52 is best shown in FIGS. 2 and 10. It is of a polygonal cross-section, typically for example a square cross-section, having a series of equally spaced teeth 55 on each side. The teeth 55 may have a different spacing on the sides to provide for different spacing on the work table 26 of the tag 35 or nameplate which is to be marked. The feed rack 52 may be rotated to present the different sides to the feed pawl 54 for different spacing operations. The feed bar 52, as shown in FIG. 10 is comprised of a series of equally spaced teeth 55 at the bottom side which are adapted to be engaged by the teeth 96 and 98 of the feed pawl 54 as will be more fully described.

Figure 22:
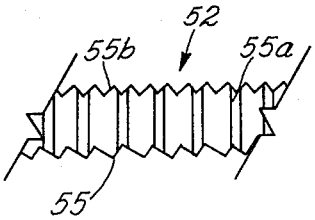
FIG. 22 is an enlarged fragmentary view in elevation of a middle portion of the feed bar showing different spacing of the feed teeth on different sides of the bar.

It will be further understood that in addition to the bottom side the other three sides of the feed bar 52 may be provided with teeth 55 of different spacing to provide for different spacing increments of the work table 26 as it is moved in each marking operation. This relationship is well shown in FIG. 22 where teeth **55*c* and 55*d* are shown at greater and lesser spacing relative to teeth 55** on two additional sides.

The left end of the feed bar 52 is of a circular cross-section at the end portion 56. This circular end portion or cylindrical end portion 56, is journalled underneath the work table 26. A tapped hole 58 is provided which may receive a bolt 57 or the like and a washer 61 for retention in the bearing 59 which may be suitably supported on the work table 26 while permitting rotational movement and a slight axial movement in the space 63 between the bearing block 59 and shoulder 65 of the feed bar 52 as shown in FIG. 10.

Figure 11:
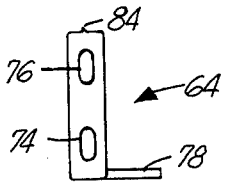
FIG. 11, is a top plan view of the half-tooth lock pawl.
Figure 12:
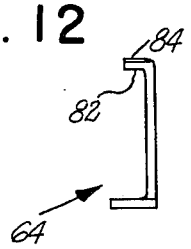
FIG. 12, is a view in side elevation of the half-tooth lock pawl taken from the left side.
Figure 13:
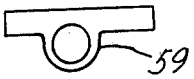
FIG. 13, is a view in front elevation of the feed rack bearing block for the left end of the rack.

The right end of the bar 52 as shown in FIG. 10 is provided with a pair of half-teeth or notches 60 and 62 acting as a detent means. These notches 60 and 62 are situated apart half the distance between the spacing of the teeth 55. The notches 60 and 62 are adapted to be engaged by a half-tooth lock pawl 64 as best shown in FIGS. 11 and 12 by manual axial movement of the right end handle portion 67 of the rack 52 one half tooth distance. In this manner the work table 26 may be manually moved the distance of one-half tooth to vary the spacing for a particular marking operation as desired.

Figure 15:
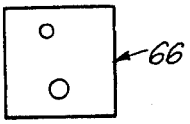
FIG. 15, is a top plan view of the right end feed rack bearing block.
Figure 14:
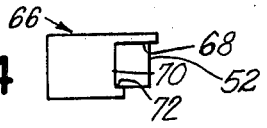
FIG. 14, is a view in left side elevation of the feed rack bearing block for the right end of the rack.
Figure 16:
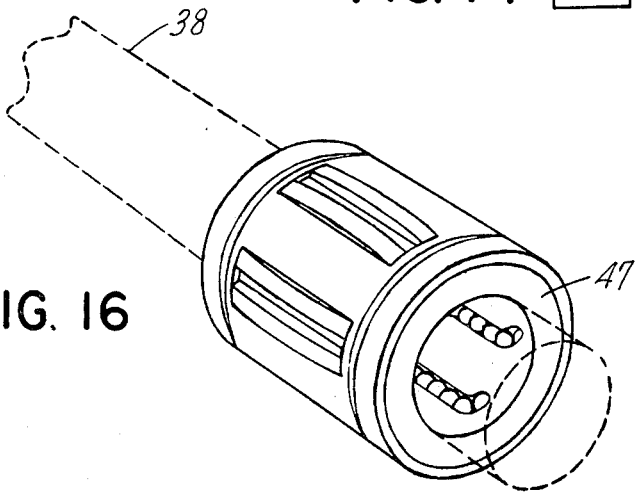
FIG. 16, is a pictorial view of a linear ball bearing assembly for the carriage guide rod.
Figure 17:
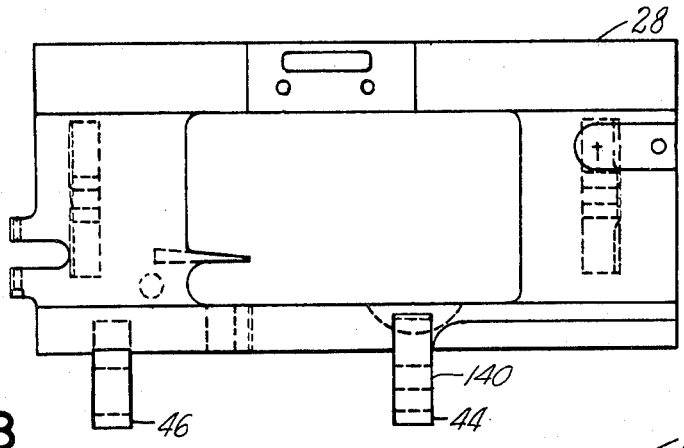
FIG. 17, is a top plan view of the carriage casting.
Figure 18:
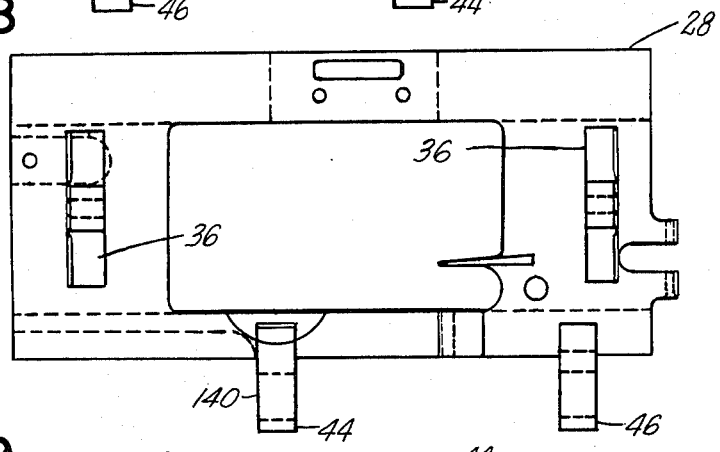
FIG. 18, is a bottom plan view of the carriage casting.
Figure 19:
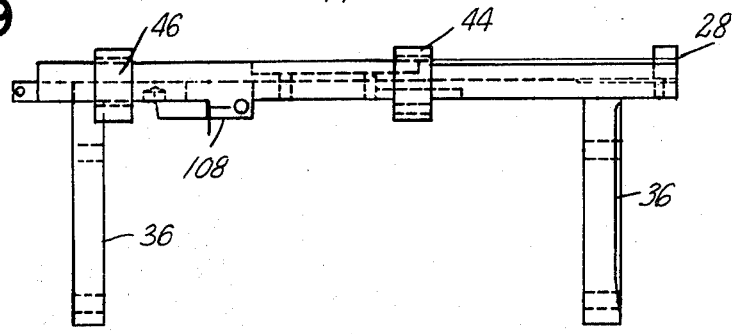
FIG. 19, is a front elevational view of the carriage casting.
Figure 20:
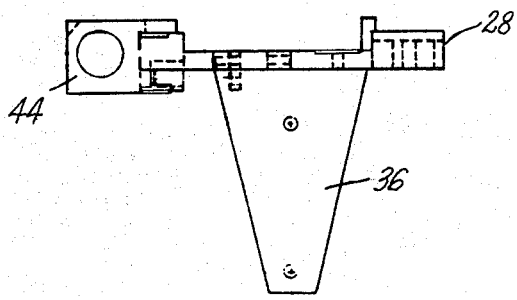
FIG. 20, is a right side elevational view of the carriage casting.
Figure 21:
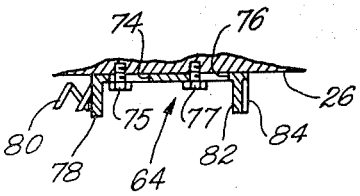
FIG. 21 is a fragmentary view in vertical section through a long axis of the half tooth lock pawl showing its slidable mounting.

The feed rack 52 is supported at the right end underneath the work table 26 by bearing block 66. The bearing block 66 as best shown in FIGS. 2, 14 and 15 is supported underneath the work table 26 and is comprised of sides 68 and 70 which are co-extensive and co-terminous with the sides of the feed rack 52. A lip 72 is located underneath the feed rack 52 and permits the polygonal end portion of the feed bar 52, which in the drawing is shown as a squared cross-section, to be rotated against the biasing action of the half-tooth lock pawl 64.

The half-tooth lock pawl 64 as best shown in FIGS. 2, 11, 12 and 21 has a pair of slots 74 and 76 which receive loosely a pair of connecting bolts 75 and 77 underneath the work table 26 which serve as guide pins so that the pawl 64 may be loosely held for sliding movement underneath the work table 26. This function is well shown in FIG. 21. A handle member 78 extends to one side and biasing spring 80 urges the half-tooth lock pawl 64 against the feed rack 52. A flange member 82 is formed in one end of the half-tooth lock pawl 64 which is biased toward the feed rack 52 and is provided with a tooth element 84 which engages one of the two notches 60 and 62 which define the half-tooth spacing means on the feed rack 52. When the feed rack 52 is desired to be moved a half-tooth distance for a half-spacing movement the half-tooth lock pawl 64 is simply drawn back slightly and the feed rack 52 is moved either from the notch 60 to the notch 62 or, vice-versa, as desired.

Figure 4:
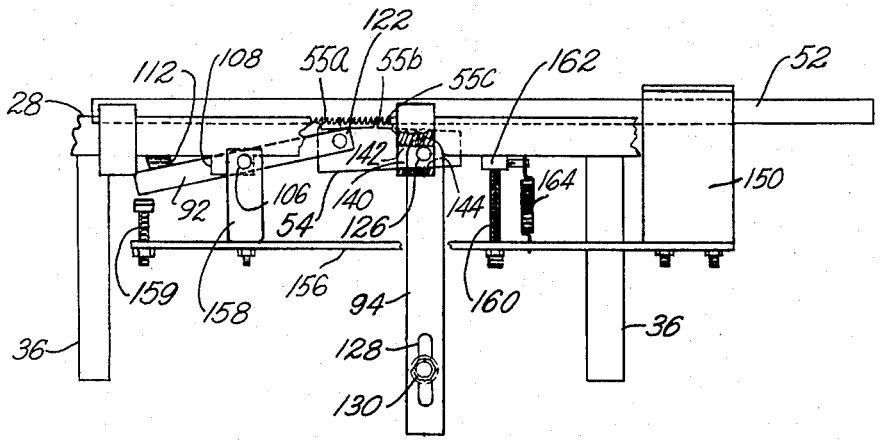
FIG. 4, is a fragmentary view in front elevation with part of the work table removed showing the feed pawl and rack mechanism and the work table in the rest position.
Figure 5:
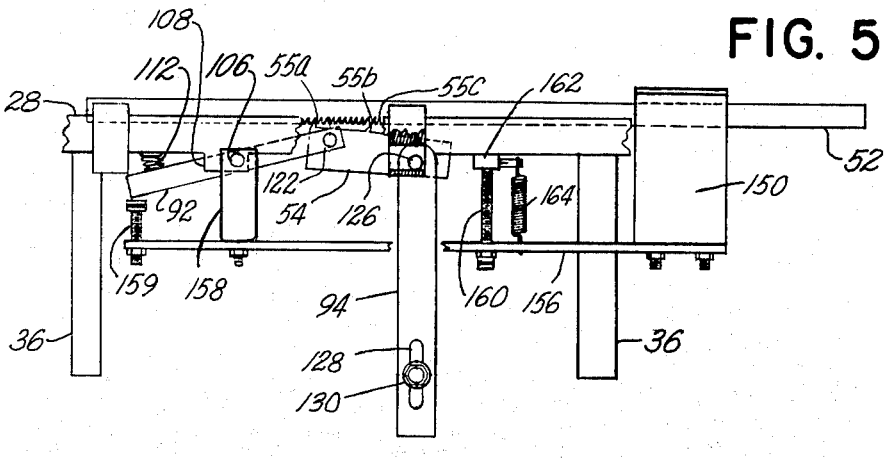
FIG. 5, is a view similar to FIG. 4, but showing the work table in the elevated and marking position.
Figure 6:
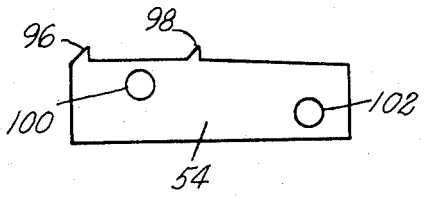
FIG. 6, is a view in front elevation of the feed pawl.

The feed pawl advancing mechanism is best shown in FIGS. 1, 4 and 5 for the assembly mechanism. The feed pawl 54 shown in FIGS. 4 and 5, is pivotally supported at the left end by a feed pawl link 92 and at the right end by a feed pawl drag link 94. The feed pawl 54 is comprised of a left end tooth 96 and a right end tooth 98 which are engageable with selected teeth 55 of the feed rack 52. In the preferred operation the spacing of the teeth 96 and 98 may for purpose of example be 0.765 inches while the spacing of the teeth 55 on the feed rack 52 with which the teeth 96 and 98 of the feed pawl 54 are engageable is 0.750 inches. The difference in the spacing enables the teeth 96 and 98 of the feed pawl 54 to walk so to speak or bear against the teeth 55 on the feed rack 52 in the advancing operation. It will be understood however, that by the simple reversal of the operation of the feed pawl advancing mechanism the distance between the teeth 96 and 98 of the feed pawl 54 instead of being slightly greater than the respective distance of the teeth 55 of the feed rack 52 may be slightly less. The spacing between the teeth on the feed rack 52 is in multiples which are divisible by 0.750 in order to obtain the proper relationship with a single feed pawl 54.

The feed pawl 54 is further provided with holes 100 and 102 which receive pins 122 and 126, respectively connecting the pawl 54 to the feed pawl link 92 and the drag link 94, respectively.

Figure 7:
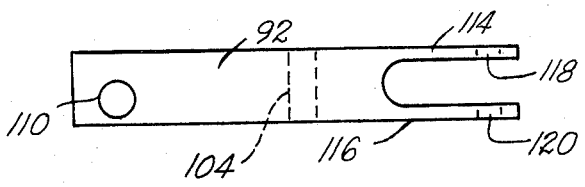
FIG. 7, is a top plan view of the feed pawl link.
Figure 8:
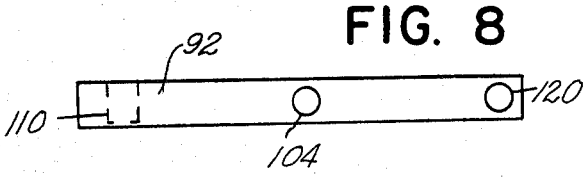
FIG. 8, is a view in front elevation of the feed pawl link.

The feed pawl link 92 is best shown in FIGS. 1, 7 and 8. It is provided with a central opening 104 which receives a pin 106. The pin designated by the reference numeral 106 supports the link 92 and is journalled within a boss 108 on the carriage casting 28. The feed pawl link 92 is further provided with a cup-shaped recessed seat 110 which receives a spring 112 which at its other end bears against the underneath side of the carriage casting 28. The right end portion of the feed pawl link 92 is bifurcated and has a pair of tongue members 114 and 116 which are provided with holes 118 and 120, respectively. These holes 118 and 120 receive a pin 122 connecting the feed pawl link 92 with the hole 100 in the feed pawl 54.

Figure 9:
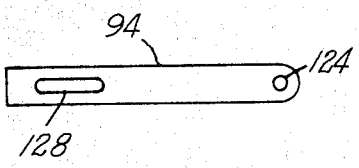
FIG. 9, is a view in front elevation of the feed drag link.

The drag link 94 is best shown in FIGS. 1 and 9. The drag link 94 is provided with a hole 124 which receives pin 126 connecting it to the feed pawl hole 102. The bottom end of the drag link 94 is provided with an elongated slot 128 which receives a friction clutch connection generally designated by the reference numeral 130. This friction clutch assembly is provided by a friction pad 132 at the back of the drag link 94 and which receives a bolt 134 connected to the machine 20 to provide a stationary support. The bolt 134 has an adjustment nut 136 with a biasing spring 138 so that pressure may be brought against the drag link 94 to restrain it against the force of the spring 112 acting on the feed pawl link 92. At the same time reciprocatory movement of the drag link 94 may be effected through this friction clutch mechanism where oversize tags are employed and also provide for self-adjusting relationship within limiting guide slots 140 provided in the carriage casting 28 as will be further described.

The feed pawl mechanism as best shown in FIGS. 4 and 5 further includes a guide slot provision in the carriage casting 28. This is accomplished by a groove or slot 140 having an upper side 142 and a lower side 144. This defines a limiting movement for the pin 126 which connects the feed pawl 54 with the drag link 94 and limits the movement of the feed pawl 54 upwardly and downwardly.

A carriage release button or lever 150 is provided to disengage the feed pawl 54 from the feed rack 52. When so disengaged a biasing spring 152 connected at one end to the machine base 22 and at the other over a roller 154 to the work table 26 urges the work table 26 to the left in order that the work table 26 may be moved all the way to the left or manually moved to any desired transverse position to provide for proper positioning of nameplates, tags 35 or the like which is to be marked. The carriage release button 150 is best shown in FIGS. 1, 2, 4 and 5. The release button 150 is connected to a release shaft 156 which is pivotally supported by a yoke 158 pivotally supported by pin 106. At the left end an adjustment bolt or contact member 159 is adjusted so that it is normally just a few thousands of an inch out of engagement with the feed pawl link 92 during the normal operation of the mechanism. A further adjustment bolt 160 is provided at the right end of the shaft 156 and is biased against a bearing block 162 underneath the carriage casting 28 by a biasing spring 164. When the carriage release is desired to be operated the button 150 is pressed downwardly to move the adjustment bolt 159 slightly upwardly to engage the feed pawl link 92 and rotate it clockwise as viewed in FIG. 4. This causes the disengagement of both teeth 96 and 98 of the feed pawl 54 with the feed rack 52 and enables the work table 26 to be moved manually to a desired position or by the force of the biasing spring 152 to move all the way to the left on the carriage casting 28 by sliding movement on the carriage guide rod 38.

OPERATION

The operation of this machine 20 is conventional for this type of operation of machine where the rotary marking wheel 24 is continuously rotated until a keyboard character is operated. At this point the desired symbol corresponding to a letter or numeral is stopped at the marking position directly overlying the work table 26. The ratchet mechanism is operated to cause it to stop while at the same time the camshaft clutch actuating mechanism is engaed to connect the camshaft and cause it to drive one single revolution per operation of the keyboard. The rotation of the cam 32 causes the work table 26 to be raised and lowered one full cycle and perform the marking operation. Pressure is applied between the marking wheel 24 and the work piece be it a tag 35 or a nameplate or the like held by the work table 26 to perform this marking operation. In this marking operation the sequence of engagement and disengagement of the feed pawl 54 with the feed rack 52 will be described below.

In the rest position the work table 26 is lowered and the relationship of the feed pawl 54 and associated linkage and feed rack 52 is shown in FIG. 4. In this position a feed rack tooth 55 bears against the right hand tooth 93 of the feed pawl 54 in biased relation by the force of the work table biasing spring 152. The left hand tooth 96 of the feed pawl 54 is spaced slightly to the left of a tooth 55*a* of the feed rack 52 next to it on the right hand side. The limit pin 126 connecting the feed pawl 54 with the top of the drag link 94 by the action of a previous operation may be driven slightly downwardly and may bear against the top side 142 of the limit slot 140 in the carriage casting 28 as shown. The engagement of the right hand tooth 98 of the feed pawl 54 with the tooth 55*b* of the feed rack 52 is accomplished by the force of the biasing spring 112 acting on the left hand end of the feed pawl link 92.

When a marking operation is commenced, the camshaft or eccentric cam 32 rotates one full revolution to raise and lower the table 26 while the marking wheel 24 is stopped and with the upward work table movement the marking is effected. At the beginning of this table raising operation the eccentric cam 32 as it rotates causes the bearing or thrust bar 34 connected to the underside of the carriage casting 28 to move upwardly. At the beginning of the upward movement of the carriage casting 28 the top side 142 of the guide slot 140 moves out of contact with the limit pin 126 connecting the feed pawl 54 to the drag link 94. The force of the biasing spring 112 acting on the left hand of the feed pawl link 92 causes the feed pawl 54 to move a slight degree clockwise about the limit pin 126 moving the right hand tooth 98 of the feed pawl 54 out of engagement with the rack 52 while moving the left hand pawl tooth 96 slightly upwardly. The table 26 by the force of the biasing spring 152 then moves the feed rack tooth 55*a* into engagement with the left hand tooth 96 of the feed pawl 54 by a very slight degree of movement. The work table 26 and carriage casting 28 continue to rise to the top of the stroke. When the top of the stroke is reached the tag 35 or other material to be marked is held in conventional fashion upon the work table 26 and is marked by the marking wheel 24 which by magnetic clutch actuation stops at this precise point and the printing of the selected character is effected.

After the marking operation at the top of the stroke the work table 26 begins to be lowered by the biasing action of springs 31 acting on the carriage casting 28 and the continued rotation of the eccentric cam 32. As the table 26 moves downwardly the feed pawl link 92 is caused to move a slight degree of movement clockwise and the feed pawl 54 moves then a slight degree counterclockwise. When this movement is effected the left hand tooth 96 of the feed pawl 54 is moved out of engagement with the feed rack 52 and at this precise moment the right hand tooth 98 of the feed pawl 54 is moved into the gap between the tooth 55*b* and the next adjacent tooth 55*c* of the feed rack 52. The table 26 moves to the left by the force of the work table biasing spring 152 and is caught by the next adjacent tooth 55*c* to the right of the tooth 55*b* bearing against the right hand tooth 98 of the feed pawl 54. The table 26 is then lowered to the rest position to await the next marking operation. In the afore-mentioned operation the table 26 is adjustable for different heights by a conventional carriage lever 81.

The drag link 94 through its friction clutch connection 130 accommodates different thicknesses of work tags 35 or the like to be marked. Thus the movement of the clutch connection 130 within the vertical slot 128 of the lower portion of the drag link 94 accommodates such different thicknesses. The drag link 94 is self-adjusting for the different thicknesses of work tags 35 to be marked by the simple operation of a conventional spacer bar (not shown) on the keyboard which automatically sets up the drag link 94 and its limited motion within the guide slot 140 for the next marking operation.

In the afore-mentioned operation of the work table 26 and the feed pawl 54 and feed rack 52 mechanism and drive components the movement of the work table 26 and carriage casting 28 to the upper and lower limit positions is slightly greater than the depth of the guide slot 140 in the carriage casting 28 which limits the upward and downward movement of the connecting limit pin 126 which connects the feed pawl 54 and the drag link 94. This causes the drag link 94 to move slightly in the upper and lower positions which movement is accommodated by the friction clutch connecting it at the bottom. The friction clutch connection 130 is simply adjusted to provide the aforementioned movement yet at the same time is sufficiently strong to hold against the force of the biasing spring 112 acting on the left end of feed pawl link or lever 92.

When it is desired to move the work piece carried by the work table 26 a half-space this operation is simply effected. The half-tooth lock pawl 64 is simply engaged by the handle 78 to move it slightly backwardly and the feed rack 52 is then moved from either engagement with notch 60 or 62, or vice-versa, as desired. The feed pawl mechanism will then operate as previously described but a half-space off in relation to previous marking. It will be understood that the feed rack 52 may be changed a half-tooth distance with respect to the work table 26 for a single marking operation and reset or for all subsequent marking as desired by the operator.

Further the feed rack 52 may be simply rotated to present an entirely different spacing of characters. Each side of the square shaped feed rack 52 may be provided with differently spaced teeth 55 so that the operator can choose the proper spacing by simply selecting any of the four sides. It will be understood that a polygonal relationship may be used for the feed rack 52 such that it may be either triangular, square shaped as shown, hexagonal and the like as desired by simply changing the bearing block relationship as necessary and as will be obvious to those skilled in the art.

The carriage release operation is simply effected by merely depressing the carriage release button or handle 150. This operation causes the shaft 156 to rotate clockwise a slight degree to contact the contact bolt 158 with the underneath side of the feed pawl link 92 as best shown in FIGS. 4 and 5. This contact against the force of the biasing spring 112 causes the feed pawl 54 to move slightly downwardly as the feed pawl link 92 rotates a slight degree clockwise and disengage both of the feed pawl teeth 96 and 98 with the feed rack 52. The work table 26 is then unlocked and acts with the biasing spring 152 to move to the left unless restrained by the operator to be moved to any desired transverse position. When pressure is released from the carriage release button 150 the locking relationship is re-established as shown in FIG. 4 to the rest position.

The marking machine of this invention with the improved advancing feed pawl and rack mechanism is very adaptable with respect to trouble-free operation and accommodating different thicknesses of nameplates, plastic tags or the like to be marked. The machine is simply operated and maintained and is rugged in its operation. By means of the improved half-spacing adjustment and selective teeth for different spacings the marking spacing may be varied for selected operations.

Various changes and modifications may be made within this invention as will be readily apparent to those skilled in the art. Such changes and modifications are within the scope of teaching of this invention as defined by the claims appended hereto.

What is claimed is:

1. In a marking machine having a moveable work table supporting a work piece to be marked by marking characters, said table being relatively moveable with respect to said characters to advance the work piece as said work piece is being marked, table advancing mechanism comprising a toothed feed rack having a series of teeth equi-distantly spaced along a side of the rack and feed pawl means engageable with said rack for advancing said table the distance between adjacent teeth for each marking operation, the improvement comprising means for providing a half-tooth spacing, said half-tooth spacing means comprising means for supporting said rack for limited axial movement between first and second positions separated by a half space distance while maintaining said rack against rotational movement with respect to the table, and means for holding the rack selectively in said first and second positions by a half spacing latch member engageable with said rack, said means for holding the rack at said positions comprising detent means on the rack at said first and second positions and the half spacing latch member being provided with a detent engaging element biased into engagement therewith.

2. The marking machine of claim 1, in which the detent means comprise a pair of notches in the rack spaced apart one-half the distance between the teeth on said rack.

3. In a marking machine having a moveable work table supporting a work piece to be marked by marking characters, said table being relatively moveable with respect to said characters to advance the work piece as said work piece is being marked, table advancing mechanism comprising a toothed feed rack having a series of teeth equi-distantly spaced along a side of the rack and feed pawl means engageable with said rack for advancing said table the distance between adjacent teeth for each marking operation, the improvement comprising means for providing a half-tooth spacing, said half-tooth spacing means comprising means for supporting said rack for limited axial movement between first and second positions separated by a half space distance while maintaining said rack against rotational movement with respect to the table, and means for holding the rack selectively in said first and second positions by a half spacing latch member engageable with said rack, said feed rack having a polygonal cross-section defining a plurality of flat sides, and selected sides having spaced teeth of a different spacing from the other sides, said rack being rotatably journalled on said machine to present a selected side of the rack for engagement with the pawl means to provided a selected spacing of the marking characters and the rack having a first end portion of a circular cross-section which is rotatably journalled in a bearing means and a second end of the rack having a polygonal cross-section and biasing means for urging a selected one of said flat sides of the second end against a holder member having a mating flat side portion.

* * * * *